US005992127A

United States Patent [19]

Quinif

[11] Patent Number: 5,992,127

[45] **Date of Patent: *Nov. 30, 1999**

[54] UNIVERSAL EXPANDABLE SPACER CORES FOR HOLLOW DOORS AND THE METHOD OF MAKING SAME

[76] Inventor: Edward G. Quinif, 6237 Sage Dr., Scottsdale, Ariz. 85253

[ * ] Notice: This patent is subject to a terminal disclaimer.

[21] Appl. No.: 08/854,356

[22] Filed: May 12, 1997

[51] Int. Cl.[6] ..... E04C 2/36; E06B 3/74

[52] U.S. Cl. ..... 52/784.14; 52/456; 52/793.1; 52/794.1; 428/116

[58] Field of Search ..... 52/456, 457, 784.14, 52/784.15, 784.25, 793.1, 794.1; 428/116

[56] References Cited

U.S. PATENT DOCUMENTS

| | | | |
|---|---|---|---|
| 2,511,620 | 6/1950 | Clements | 52/784.14 X |
| 2,809,403 | 10/1957 | Clements | 52/784.14 X |
| 3,385,002 | 5/1968 | Quinif | 52/784.14 X |
| 4,583,338 | 4/1986 | Sewell et al. | 52/784.14 X |
| 5,167,105 | 12/1992 | Isban et al. | 52/784.15 X |
| 5,236,392 | 8/1993 | Fauciglietti | 52/455 |
| 5,573,818 | 11/1996 | Haywood et al. | 52/793.1 X |

*Primary Examiner*—Carl D. Friedman
*Assistant Examiner*—Timothy B. Kang
*Attorney, Agent, or Firm*—Dykema Gossett PLLC

[57] ABSTRACT

A door is provided that has a first outer skin and a second outer skin. A first and second outer skins are separated by a frame to form a hollow core between the frame and the outer skins. The outer skins have molded potions that extend into the space between the outer skins. An expandable spacer is connected to the first and second skins to hold the first and second skins a predetermined distance apart. The expandable spacer has a plurality of elongated members having a width. The elongated members are each oriented substantially perpendicular to the first and second outer skins. The expandable spacer has a plurality of expandable core liners extending between the elongated members. The expandable core liners support the elongated members with respect to the first and second outer skins in a perpendicular direction. The elongated members and the expandable core liners have a reduced width portion formed therein that corresponds to the molded portion of the outer skins.

17 Claims, 3 Drawing Sheets

UNIVERSAL EXPANDABLE SPACER CORES FOR HOLLOW DOORS AND THE METHOD OF MAKING SAME

BACKGROUND OF THE INVENTION

The present invention relates generally to hollow core doors and more specifically to a universal expandable core structure inserted within the interior of the door to provide support particularly for the skins of many types of molded doors.

Hollow core doors are commonly used in many types of buildings. The common structure of a hollow core door includes a pair of door skins which are separated by a wood frame. The wood frame has vertical wood stiles joined to upper and lower horizontal wood rails. The wood stiles and rails form the edges of the door. A lock block may also be included in the area of the door where locks and handles are attached. The lock block provides the additional support that is needed to secure a lock in the door. A hollow area is enclosed between the two door skins and within the frame. The hollow area typically requires some type of structural reinforcement.

One type of reinforcement commonly used in hollow core doors is a honeycomb core structure that is glued in place between the door skins. The honeycomb core structure may be, for example, corrugated board. The honeycomb structure is supplied in an unexpanded manner. The honeycomb core is stretched across the skin of the interior of the door. One problem with using such a honeycomb core structure is that it is difficult to stretch to achieve an even honeycomb pattern within the door. Commonly, the honeycomb core must be overstretched and then manipulated into place. This process is labor intensive and thus not a cost effective manner for manufacturing the door.

The honeycomb core fully extends between the horizontal rails and vertical stiles to completely fill the hollow interior. Consequently, more core material is inserted within the interior of the door than is actually required for support. The extra core material increases the cost of the door.

The honeycomb core has also been routed out in places to fit over the panels of molded doors. Such a honeycomb version failed because it was not possible to control the spread of members or strips since some of the members or strips would get caught or hung up on the top of the panels. Also, over expansion of the honeycomb core was hard to control.

Another type of door reinforcement includes solid blocks placed strategically between the door skins. The solid blocks are commonly formed of laminated strips of corrugated or from pieces of styrofoam. The use of multiple pieces of strips or blocks laid in the doors takes more set up time and requires a large quantity of material which is expensive. Also, these solid blocks require a significant amount of glue to be spread over their entire surface to bond to the outer skins of the door.

The outer skins of hollow core doors may be formed using a planar flush panel or they may have a contoured colonial-type molded panel configuration. In a colonial-type panel configuration, a portion of the panel extends into the hollow interior of the door. The thickness of the hollow space in that area is reduced. Inserting a honeycomb structure or core in such a door is undesirable since the honeycomb core would have to be reduced in thickness in the areas where the panel extends within the hollow interior of the door.

There are several types of molded panel doors that match various decors of homes. However, the hollow cores described above must be manipulated or reconfigured for different styles of doors. It is therefore desirable to manufacture a hollow core that may fit with a number of different doors having various styles of molded panels.

It is also desirable to provide a structural core or support for a hollow core door which requires less set-up time and is cost effective by being easy to manufacture and by using a reduced amount of core material and glue.

SUMMARY OF THE INVENTION

It is therefore an object of the invention to provide an improved construction for hollow core doors having various styles of molded panels.

In accordance with one aspect of the invention, a door is provided that has a first outer skin or panel and a second outer skin or panel on opposite sides of the door frame. The first and second outer skins are separated by a frame to form a hollow interior or space therebetween. The first and second skins also have molded portions that extend into the space therebetween and reduce the width between the skins. An expandable spacer core is connected to the first and second skins and hold the first and second skins a predetermined distance apart. The expandable core spacer has a plurality of elongated or corrugated members having a width. The elongated members are each oriented substantially perpendicular to the first and second outer skins. The expandable spacer core has a plurality of expandable core liners extending between the elongated members. The expandable core liners orient the elongated members in the perpendicular direction with respect to the first and second outer skins. The elongated members and the core liners have reduced width portions formed therein that corresponds to the molded portions of outer skins.

In accordance with another aspect of the invention, a method for forming a door includes applying adhesive to an adhesive region of a plurality of strips of foldable material, arranging a plurality of strips of foldable material between a plurality of corrugated layers, cutting through the plurality of corrugated layers and across the foldable material to form an expandable spacer core held together by the foldable material, reducing the width of the expandable spacer core and the foldable material in a predetermined area, and affixing the expandable spacer core between a pair of spaced apart first and second outer skins.

It is an advantage of the invention that the expandable spacer cores are easily placed within the interior of the hollow core doors thus resulting in relatively less manufacturing time. In particular, the core liners hold the elongated members upright and perpendicular to the outer skins during assembly.

Yet another advantage is that the expandable spacer core may be placed to hold the elongated members in the panel areas and in the center of the door so that the reduced width portions of the elongated members and the core liners align with the molded portions without interfering with the reduced thickness between the molded portions of the door. The expandable spacer core may easily be stretched into place without catching on the molded portions.

In forming the door, an adhesive is applied to the edges of the expandable spacer core. The expandable spacer core is placed on the hollow space side of an outer skin. The frame of the door may also be connected to the hollow core space of an outer skin. The second outer skin is then placed on top of the frame and the expandable spacer cores to form the door.

Thus, in the present invention, the expandable spacer cores are placed in strategic areas to support the door skins.

The expandable core liners hold the elongated corrugated elements perpendicular to the skin. The combination of the core liner and adhesive forms pillars of strength between the door skins. The reduced width portions of the core liners contact the molded areas to keep the panel strips perpendicular to the skins.

BRIEF DESCRIPTION OF THE DRAWINGS

Other features and advantages of the present invention will become apparent from the following detailed description which should be read in conjunction with the drawings in which.

DETAILED DESCRIPTION OF THE PREFERRED EMBODIMENT

Figure 2:
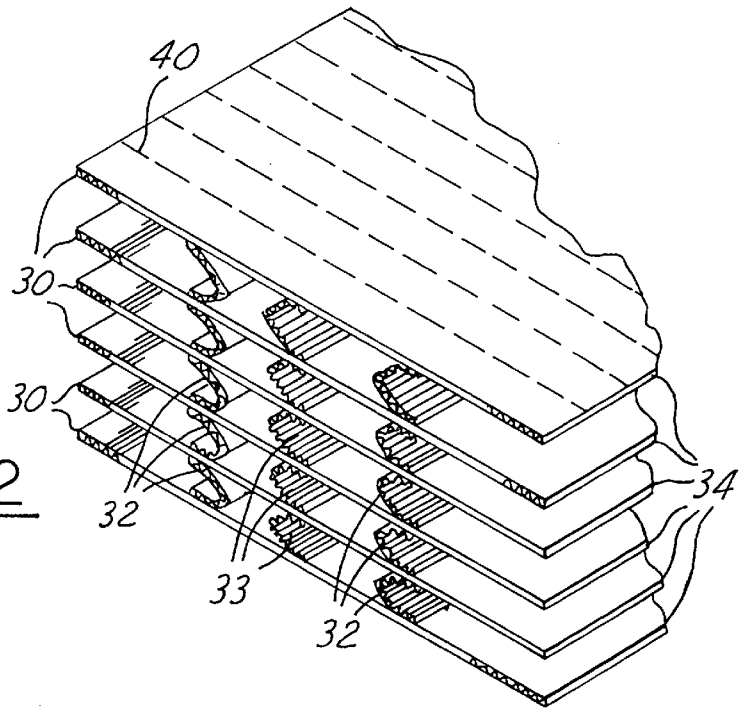
FIG. 2 is a side view of a set of corrugated boards, sheets or layers connected by expandable core liners prior to being cut to form the expandable spacer cores.

Referring now to the drawings like reference numerals are used to identify identical components in the various views. Although the invention will be illustrated in the context of a hollow core four panel door, it will be appreciated that this invention may be used with other hollow core doors, as examples, flush doors or other styles of molded panel doors.

Figure 1:
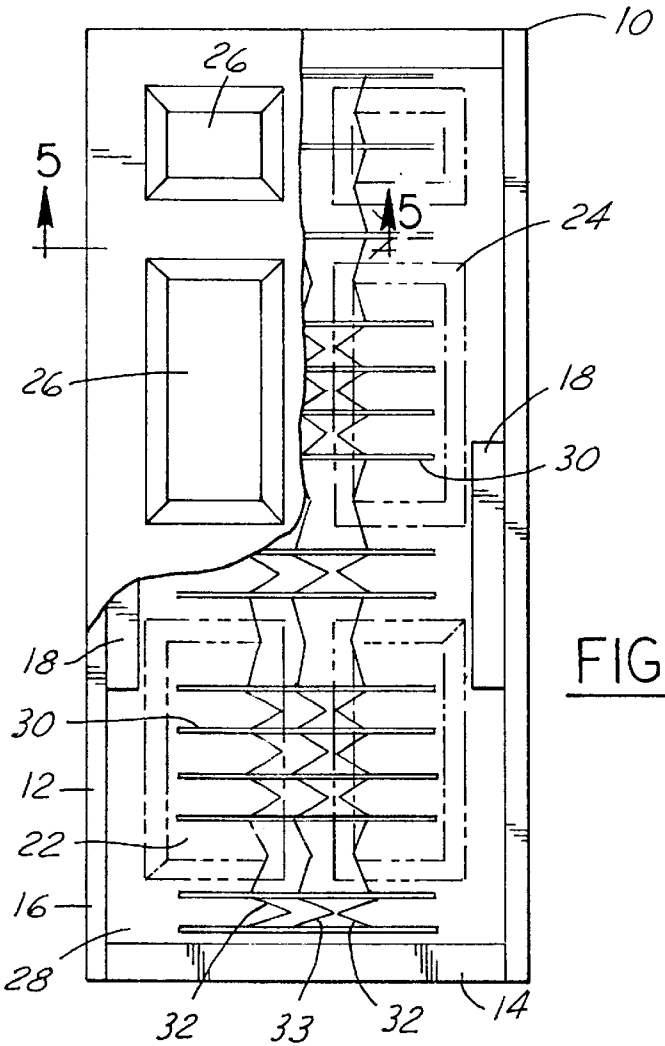
FIG. 1 is an elevational view of a hollow core door with parts broken away to expose the interior of the door.

Referring now to FIG. 1, a hollow core door 10 has a frame 12 around its perimeter. Frame 12 comprises horizontal rails or stiles 14 and vertical stiles 16. In the preferred embodiment horizontal rails 14 and vertical stiles 16 are formed of solid wood. A lock block 18 may also be part of the supporting structure of door 10. Lock block 18 is used at the location in which the door handle and locks may be fastened.

Door 10 has a pair of outer skins, sheets, or panels 20, one of which has been removed to reveal the inner structure of door 10. Outer skins 20 may be planar as in a flush-type door. Outer skin 20 as shown incorporates a number of molded panels 22. Panels 22 consist of a molded portion 24 and a planar portion 26. Molded portion 24 extends into the interior space 13 between the outer skins 20. Thus, the thickness between molded portions 24 has a reduced thickness. It is preferred that planar portion 26 lies on the same plane as the portions of the door between panels 22 and the portions adjacent to frame 12.

To provide structural rigidity and to hold the outer skins 20 apart, a rigid expandable spacer core 28 is affixed in the interior space 13 between outer door skins 20. Expandable spacer core 28 has a number of elongated members 30 that are preferably perpendicular to the plane of outer skins 20. For the present door style fifteen elongated members are used; two between the bottom panels and the bottom of the door, four within the lower panels, two between the middle panels and the lower panels and one each between the upper and middle panels, adjacent the upper panels and between the upper panels and the top of the door. Elongated members 30 extend across a portion of the width of door 10. In the present door style, elongated members 30 extend from the middle of door 10 and partially across the two planar portions 26. The elongated members are not required to extend across the molded portions 24 toward the outer edge of the door. Although for some door styles, extending the elongated members between the molded portions and the edge of the door may be desirable. In the preferred embodiment, elongated members 30 are formed of a corrugated board material. However, other types of material may be used such as wood or plastic .

Elongated members 30 also have a plurality of expandable core liners 32 that are also preferably perpendicular to the plane of outer skins 20. Expandable core liners 32 support elongated members 30 substantially perpendicular to outer skins 28. As will be described further below, it is also preferred that the expandable core liners 32 rest against molded portions 24. The thickness of expandable core liner 32 is reduced in the area of molded portions 24. During assembly, expandable core liners 32 hold elongated members 30 upright so that the core is freestanding. Expandable core liners 32 may be formed of a single face corrugated board material or paper.

Optionally, a central expandable core liner 33 may also be strategically placed between molded portions 24 adjacent to planar portion 26 for extra support. Central expandable core liners 33 also support elongated members 30 substantially perpendicular to outer skins 28 between molded portions 24 of panel portions 26. Central expandable core liners 33 are suitable for door applications in which the elongated members 30 require extra support in the center of the door. Central expandable core liners 33 do not require a reduced width portion for most styles of doors. As will be described below, if a central expandable core liner 33 is used for certain styles, a reduced width portion may need to be included. Central expandable core liners 33 may also be formed of a single face corrugated board material or paper.

Referring now to FIG. 2, the result of the first few steps in forming an expandable spacer core 28 is shown. Expandable core liners 32 and optional central core liners 33 are shown in their relative positions to corrugated boards, sheets or layers 34. Only six corrugated layers 34 are illustrated. In one constructed embodiment, fifteen corrugated layers 34 were used. Expandable core liners 32 are folded pieces of corrugated board material or paper. Expandable core liners 32 are preferably placed parallel to each other. For a common door width, two expandable spacer cores 32 may suffice, but a central expandable core liners 33 may be used. Further, additional core liners 32 may be used depending on the design requirements of the particular door. Each of corrugated layers 34 are connected to the adjacent layer by expandable core liners 32.

In one embodiment, elongated members 30 are 19 inches long. Core liners 32 and central core liner 33 are formed of eight inch pieces of single layer corrugated folded in half.

Expandable core liners 32 are shown affixed to corrugated layers 34. Corrugated layers 34 and expandable core liners 32 are cut along cut lines 40. Cut lines 40 run in a direction across expandable core liners 32 so that after cutting, expandable core liners 32 hold together the strips of corrugated layers 34. The cuts along cut lines 40 may be performed using a rip saw or other similar cutting mechanism. Once cut, the corrugated layers 34 form elongated members 30 of FIG. 1.

When cut a portion of expandable core liner 32 and central core liner 33 are cut. For some door styles, central core liner does not need to be cut.

Figure 3:
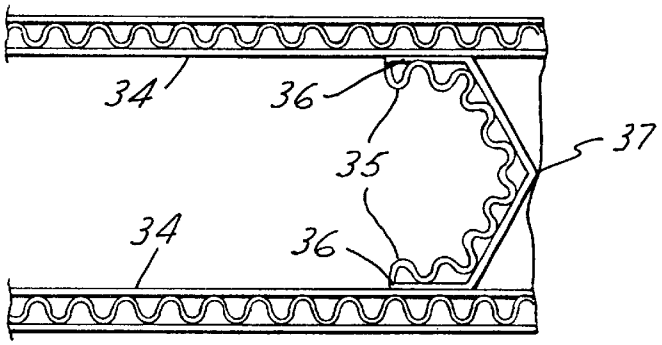
FIG. 3 is a fragmentary cross-sectional view of a pair of elongated or corrugated members separated by an expandable core liner.

Referring now to FIG. 3, a cross-sectional view of an expandable core liner 32 is shown. An adhesive region 36 that extends along the elongated edges of expandable core liners 32 is the area on expandable core liners 32 to which adhesive is applied. Adhesive may be applied to the adhesive region 36 prior to joining the corrugated layers or sheets 34 together. Each expandable core liner 32 has two adhesive regions 36. Adhesive regions 36 are on opposite elongated edges of expandable core liners 32. Expandable core liner 32 has a fold line 37 to allow adjacent corrugated layers 34 to be brought closer together.

During cutting of the corrugated layers 34, along cut lines shown as 40 in FIG. 2, the rip saw provides a large force. The large force has a tendency to skew corrugated layers 34 with respect to each other. To alleviate this problem, it is preferred that single face corrugated layers are used so that the ribbed layer 35 of expandable core liners 32 are aligned so that the ribbed corrugated layer 35 fits into itself when expandable core liners 32 are folded between corrugated layers 34 to interlock. The interlocking of the expandable core liner 32 helps corrugated layers 34 remain aligned during the cutting process. Another advantage of having the corrugated layers 35 of expandable core liners 32 align is that if the expandable spacer cores 28 are to be shipped, the interlocking corrugated layers 35 help prevent corrugated layers 34 from becoming misaligned.

Figure 4:
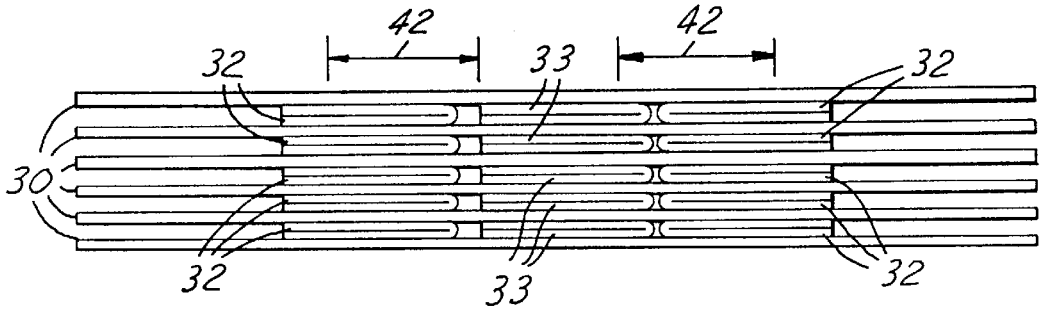
FIG. 4 is a perspective view of an expandable spacer core in a compressed configuration prior to expansion for insertion into the interior of a hollow core panel door.
Figure 5:
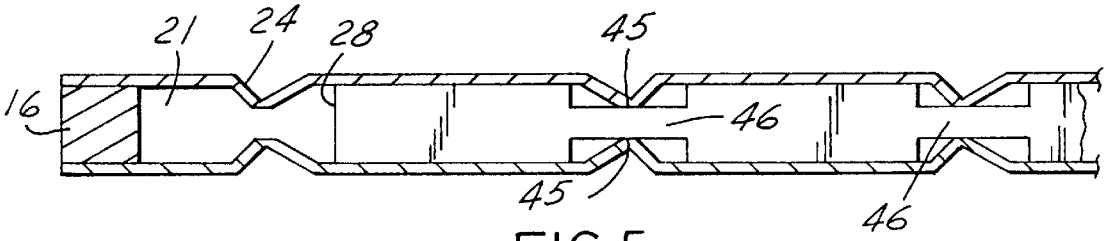
FIG. 5 is a fragmentary cross-sectional view of a door with an expandable spacer core inserted between the outer door skins or panels.

Referring now to FIG. 4 and 5, expandable spacer core 28 is shown in an unexpanded state. After being cut along cut lines 40 of FIG. 2, elongated members 30 are placed close together with expandable core liners 32 placed therebetween. Channels 42 are cut through the edges of elongated members 30 to a predetermined depth. The channel 42 are also cut into expandable core liners 32. Channels 42 are preferably cut in pairs so that the pairs in the opposite edges of expandable spacer core 28 form a narrowed portion 46. Narrowed portion 46 in expandable core liners 32 is formed to be placed to align with molded portion 24. Of course, the relative position of channel 42 may vary depending on the door style. The depth of the narrowed portions 46, is such that the narrowed portions 46, touch the molded portions 24 when inserted in the hollow core. To insure touching the narrowed portion may be cut a small fraction of an inch wider than the distance between the molded portions. The material of the core liner will slightly compress in the area where the molded portions touch it. Channels 42 may be cut using a router, saw or a similar tool.

Channels 42 may also be cut through center expandable core liner 33. Cutting a channel 42 may be optional for some door styles. The amount that the expandable core liners 32 or 33 are cut may be changed by moving the glued position of the expandable liners 32 and 33.

Figure 6:
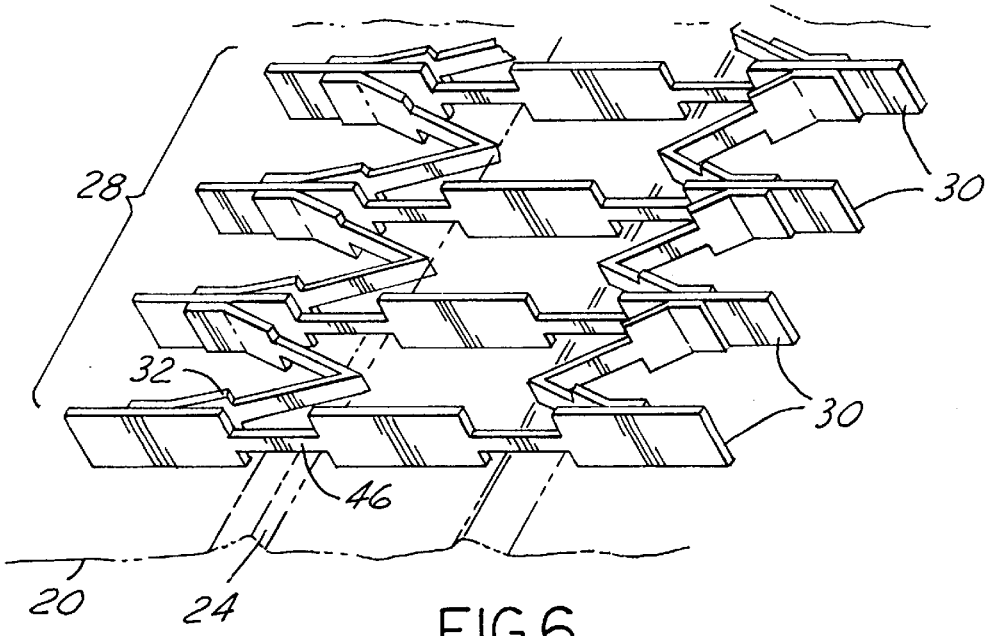
FIG. 6 is a partial perspective view of an expandable spacer core having two core liners in an expanded configuration inserted into the interior of a hollow core panel door.
Figure 7:
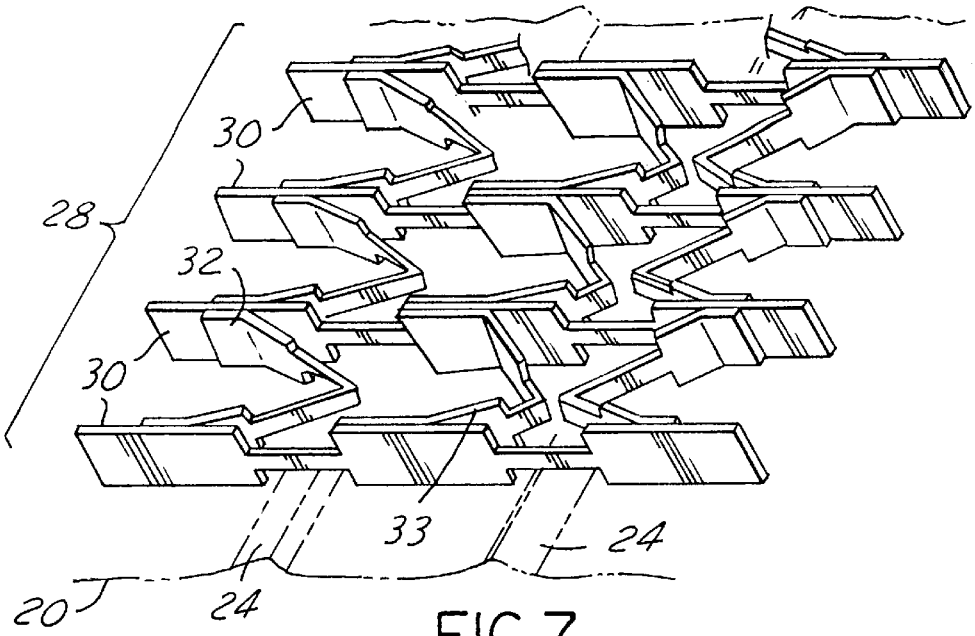
FIG. 7 is a partial perspective view of an expandable spacer core having three core liners in an expanded configuration inserted into the interior of a hollow core panel door.

Referring now to FIGS. 5, 6 and 7, expandable spacer core 28 fits within the interior or space 21 of the hollow core door. Elongated members 30 and expandable core liners 32 support outer skins 20. Vertical rails 16 separate the outer edge of outer skins 20. Molded portions 24 preferably have a flat portion 45. Narrowed portions 46 rests against flat portion 45 of molded portion 24. It has been found that in an assembled door, that the flat portions 45 of molded portions 24 assist in holding elongated members 30 perpendicular to outer skins 20. It is preferred that the width of narrowed portions 46 corresponds to the distance between flat portions 45 of molded portions 24.

The areas in which channels 42 are not machined are strategically placed between the molded portions 24 against planar portions 26 and between the molded panels in the center of the door. In this manner a significant amount of support may be applied between the outer door skins.

FIG. 6 has only two expandable core liners 32 and FIG. 7 has an additional optional center core 33. The number of core liners used depends on the particular support requirements for the door.

During assembly of door 10, the expandable spacer core 28 is manufactured as described above. Expandable spacer cores 28 may be manufactured at a separate location and brought to the assembly line where the doors are manufactured. Outer skins 20 are typically placed in a horizontal position. Frame 12 and lock block 18 may then be connected to an outer skin 20. Adhesive is then applied to the edges of expandable spacer core 28. This may occur using a double sided glue spreader common in the industry. This may also occur one edge at a time. Expandable spacer core 28 is then expanded within hollow interior or space 44. Expandable core liners 32 hold elongated members 26 in an orientation perpendicular to the plane of outer skin 20. Spacer core 28 is freestanding so it does not fall over during manufacturing. If adhesive has not been applied to the second edge of expandable spacer core 28, adhesive may then be applied. Outer skin 20 is placed to contact frame 12 and expandable spacer core 28. Because spacer core 28 is freestanding, spacer core 28 does not fall over as the outer skin 20 is positioned. Once the adhesive is set, door 10 has been formed.

Figure 8:
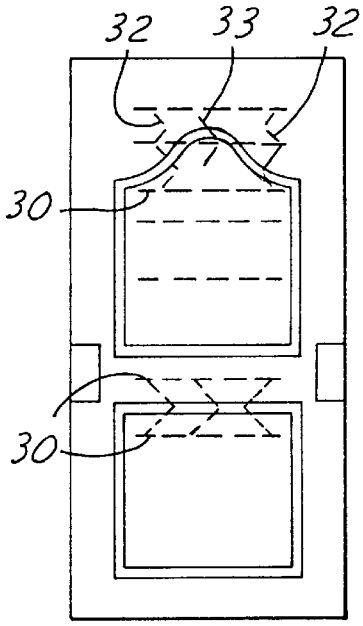
FIG. 8 is an elevational view of an alternate style of hollow core door having a partial expandable spacer core represented in hidden lines.
Figure 9:
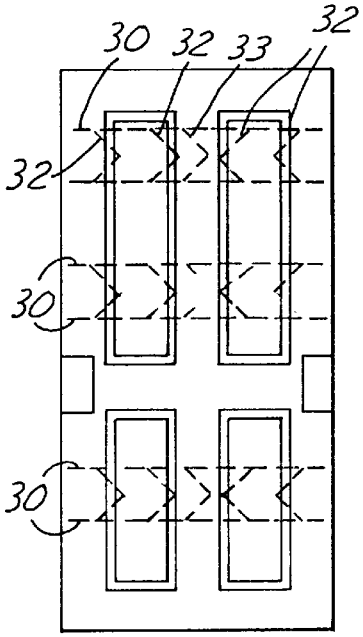
FIG. 9 is an elevational view of another alternate style of a hollow core door having a partial expandable spacer core represented in hidden lines.
Figure 10:
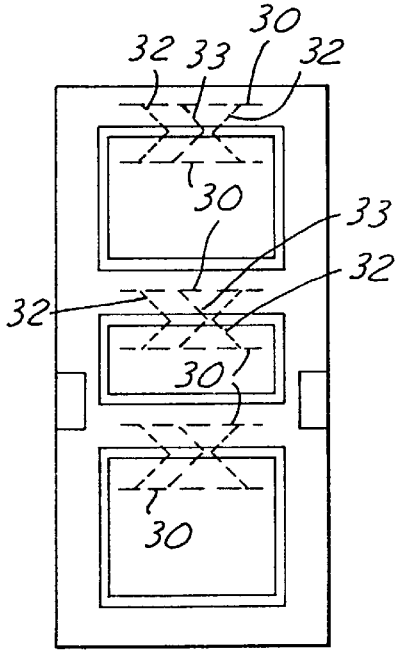
FIG. 10 an elevational view of yet another alternate style of a hollow core door having a partial expandable spacer core represented in hidden lines.

Referring now to FIGS. 8, 9 and 10, various styles of doors are shown having expandable spacer cores 28 formed according to the present invention. The reduced width portions of expandable core liners 32 and elongated members 30 are aligned with molded portions 24 as expandable spacers core 28 crosses the molded portions 24. As is demonstrated one type of expandable spacer core may be used for various styles of doors even though the expandable spacer core 28 crosses molded portions 24 in a small number or locations. Also the overall width of spacer core may be sized so that it fits within various widths of doors without having to be reworked.

In FIG. 8, the core liner may have to be torn to fit over the curved portion of the molded portion. Because the style door shown in FIG. 8 is a very low manufacturing volume door, a single type of spacer core may be manufactured for all types of doors and modified for this particular type of door. Because the core liners are formed of paper or other tearable material, the core liners can be easily torn during manufacturing.

For some door styles such as that shown in FIG. 9, additional core liners may be inserted and the length of the elongated members extended across the door so that a portion of the elongated members is placed between the molded panel and the edges of the door. Such a configuration may be easily manufactured using the teachings above. Such a configuration gives additional support to the outer door skins.

If central expandable core liners 33 are used in door styles such as that shown in FIGS. 8 and 10, central core liners 33 will have a reduced width portion cut therein so that central expandable core liner 33 may not interfere with molded portions 24. Such a configuration is shown in FIG. 4.

While not illustrated the expandable spacer core works equally well in a flush door. That is, in a door without molded portions. The core may be placed within a flush door without having to align with any molded portions.

While the best mode for carrying out the present invention has been described in detail, those familiar with the art to which this invention relates will recognize various alternative designs and embodiments for practicing the invention as defined by the following claims:

What is claimed is:

1. An expandable spacer core having an expanded form and a collapsed form with the spacer core having the same width in both forms comprising:

a plurality of elongated members which are generally parallel to one another;

a plurality of expandable core liners extending between said elongated members;

each of said expandable core liners being foldable along a fold line located generally in the middle thereof and having a pair of end portions secured to a pair of adjacent elongated members;

said expandable core liners being arranged lengthwise in end to end relationship in rows which are spaced apart;

each of said expandable core liners being stretchable about the fold line to permit variable spacing between said elongated members when the core is in its expanded form;

said spacer core having a reduced length when in said collapsed form and an extended length when in said expanded form while maintaining a uniform width.

2. The expandable spacer core recited in claim 1 wherein said expandable core liners are formed of a single face corrugated material.

3. The expandable spacer core received in claim 1 wherein said expandable core liners when said core is in said collapsed state interlock upon themselves.

4. The expandable spacer core recited in claim 1 wherein said elongated members are formed of a two-face corrugated board material.

5. The expandable spacer core recited in claim 1 wherein said expandable core liners are arranged in a plurality of rows.

6. The expandable spacer core recited in claim 1 wherein said expandable core liners are arranged in a pair of rows.

7. The expandable spacer core recited in claim 1 wherein said expandable core liners are arranged in three rows, with one row in the center of the elongated members, said other rows being spaced from the ends of the elongated members on opposite sides of said center row.

8. The expandable spacer core recited in claim 1 wherein said elongated members being provided with slots in the front and back surfaces thereof to provide reduced width portions thereon; and said expandable core liners being provided with slots in the front and back surfaces thereof to provide reduced width portions thereon.

9. A hollow core door comprising:

a rectangular frame, including a pair of side stiles parallel to each other, and upper and lower rails also parallel to each other, all of said stiles and rails being of substantially the same predetermined thickness, having their end faces lying in parallel planes, and being joined respectively at the frame corners;

an expandable structural spacer core disposed within said frame and having front and back surfaces lying in said parallel planes, said spacer core having a plurality of spaced apart elongated members which are generally parallel to one another and a plurality of expandable core liners extending between said elongated members;

said spacer core being made from a material having a collapsed form and an expanded form which permits expansion of said spacer core from its collapsed form into its expanded form in the longitudinal direction of the door and frame, with said spacer core having the same width when in either said collapsed form or expanded form;

a first outer skin and a second outer skin secured to opposite sides of said frame with said skins having panels formed therein, each of said panels outlined by a raised molding at the interior surface on said skin;

said skins also being secured to said front and back surfaces of said expandable spacer core, said expandable spacer core holding said first and second skins a predetermined distance apart;

said elongated members being located between and arranged generally perpendicular to said stiles;

said expandable core liners holding said elongated members substantially perpendicular to said outer skins during assembly;

each of said expandable core liners being foldable along a fold line located generally in the middle thereof and having a pair of end portions secured to a pair of adjacent elongated members;

each fold line being generally perpendicular to said skins;

said expandable core liners when in the expanded form being arranged lengthwise in said frame in end to end relationship in a plurality of rows which are spaced part;

portions of said elongated members provided with slots in the front and back surfaces to provide reduced width portions thereon;

portions of said expandable core liners provided with slots in the front and back surfaces thereof to provide reduced width portions thereon;

each of said expandable core liners being stretchable about the fold line to permit variable spacing between said elongated members when the core is in its expanded form to overly said raised moldings;

the reduced portions of said elongated members and said core liners overlying said raised moldings portions to provide support for said skins.

10. The hollow core door recited in claim 9 wherein said expandable core liners are formed of a single face corrugated material.

11. The hollow core door recited in claim 9 wherein said elongated members are formed of a two-face corrugated board material.

12. The hollow core door recited in claim 9 wherein said expandable core liners are arranged in said rows inwardly spaced from the ends of said elongated members.

13. The hollow core door recited in claim 9 wherein said expandable core liners are arranged in a pair of spaced apart rows.

14. The hollow core door recited in claim 9 wherein said expandable core liners are arranged in three spaced apart rows.

15. The hollow core door recited in claim 9 wherein said expandable core liners are arranged in three rows, with one row in the center of the elongated members, said other rows being spaced from the ends of said elongated members on opposite sides of said center row.

16. The hollow core door recited in claim 9 wherein there are a pair of mounting blocks extending inwardly from a portion of each of said stiles, any elongated member located between said mounting blocks having a reduced length to accommodate said mounting blocks.

17. The hollow core door recited in claim 9 wherein said expandable core liners has one row in the center of the door and the other rows equally spaced on opposite sides of the center row, said other rows being spaced from the ends of said elongated members.

* * * * *